United States Patent [19]

Nawrot

[11] 4,039,420

[45] Aug. 2, 1977

[54] HALATE CELL TOP

[75] Inventor: Chester Ronald Nawrot, Depew, N.Y.

[73] Assignee: Hooker Chemicals & Plastics Corporation, Niagara Falls, N.Y.

[21] Appl. No.: 669,949

[22] Filed: Mar. 24, 1976

[51] Int. Cl.[2] ..... C25B 9/00

[52] U.S. Cl. ..... 204/242; 204/279

[58] Field of Search ..... 204/242, 280, 128, 95, 204/279

[56] References Cited

U.S. PATENT DOCUMENTS

| | | | |
|---|---|---|---|
| 3,732,153 | 5/1973 | Harke et al. | 204/95 |
| 3,824,172 | 7/1974 | Hodges | 204/95 X |
| 3,884,791 | 5/1975 | Raetzsch et al. | 204/95 X |

FOREIGN PATENT DOCUMENTS

| | | | |
|---|---|---|---|
| 646,826 | 8/1962 | United Kingdom | 204/128 |

*Primary Examiner*—John H. Mack
*Assistant Examiner*—D. R. Valentine
*Attorney, Agent, or Firm*—Peter F. Casella; Howard M. Ellis

[57] ABSTRACT

An improved electolytic cell top for the manufacture of alkali metal halates is disclosed, wherein the cell top has a substantially improved useful life. A titanium liner forms the interior surface of the cell top, and material cost can be minimized by choosing a titanium thickness sufficient to withstand forces created by hydrostatic pressures of electrolyte and by the weight of the cell, when supported by the enclosing structure of the present invention.

15 Claims, 6 Drawing Figures

HALATE CELL TOP

BACKGROUND OF THE INVENTION

1. Field of the Invention

This invention relates to a cell top for an electrolytic cell for production of alkali metal halates. More particularly, the invention comprises a chlorate cell top with a highly corrosion-resistant lightweight metallic liner and appropriate structural reinforcing means.

Alkali metal halates, e.g., sodium chlorate, can be prepared by electrolysis of an alkali metal halide, usually purified to free it of heavy metals and of magnesium and calcium compounds. The halates may be formed by the batch method or the electrolyte may be circulated continuously. Chlorate cells generally are iron tanks which are often completely lined with concrete. Cell anodes may be constructed of graphite, or of valve metals, e.g., titanium, coated on their active electrolytic surfaces with a noble metal or a noble metal oxide or equivalent, e.g., platinum, 30 to 70 weight percent iridium and platinum alloy, or other active surface materials. Cathodes are typically constructed of iron or steel. In some designs the cell body is large, and the volume of electrodes is a small fraction of the volume of electrolyte. In other designs, typically, the entire cell is taken up by the electrodes, with a relatively small electrolyte space between electrodes.

The formation of sodium chlorate by electrolysis of a brine solution represents a complex series of electrochemical and chemical reactions. The maintenance of a high operating efficiency depends upon a number of factors including temperature, pH, addition agents, and other factors. Usual current densities for production of sodium chlorate range from about 0.5 to 1.5 amperes per square inch, at an operating temperature of 85° to 90° C. The cell liquor product of electrolysis is typically evaporated in two stages for concentration, after which separation of sodium chlorate takes place in a crystallizer. Final separation can be obtained in a batch centrifuge, and drying can be carried out in a heated air rotary dryer, after which the material can undergo grinding, screening, and packing operations. A typical electrochemical apparatus for the manufacture of halates is described in U.S. Pat. No. 3,732,153, issued May 8, 1973 to Harke et al.

In this description of illustrative embodiments of a chlorate cell top, reference will be made to the production of sodium chlorate from an aqueous solution of sodium chloride, although it is clear that this is for the purpose of simplicity of description, since it is possible to make other alkali metal halates, e.g., sodium bromate or potassium iodate, by the methods and apparatus herein described. It is furthermore to be kept in mind that various equivalent structures may be substituted for those mentioned and replacements may be made which are apparent to one skilled in the art to which this invention pertains.

BACKGROUND OF THE INVENTION - DESCRIPTION OF THE PRIOR ART

Chlorate cell tops have frequently been constructed of, or lined with, many materials which are resistant to the harsh environment of liquid and gaseous components typically present within the chlorate cell. Illustrative of some corrosive materials present in the chlorate cell are concentrated brine (about 100 to 140 grams per liter); concentrated sodium chlorate solution (400 to 500 grams per liter); sodium hypochlorite (2 to 3 grams per liter); and gas with a chlorine content of about 0.5 to 3% chlorine and an oxygen content of about 3%; all at a temperature of about 70° C. Anderson, in U.S. Pat. No. 3,401,109, issued Sept. 10, 1968, describes a concrete electrolytic cell part reinforced with cables to form a cell top. Such cell tops are heavy, and in addition require application of a sealing compound, which is apt to degrade, contaminate the cell liquor, and fail to adhere properly. The cell tops of Harke et al, U.S. Pat. No. 3,732,153, issued May 8, 1973, and Westerlund, U.S. Pat. No. 3,679,568, issued July 25, 1972, have the advantage of fabrication from lighter weight materials and the capability of being more readily repaired than materials previously described, but lack the structural rigidity and resistance to the corrosive cell environment of a chlorate cell under typical operating conditions. Glass fiber reinforced resins, as suggested by Harke et al and Westerlund, have been found to have a severely limited useful life, seldom lasting under service conditions for a period of greater than approximately six months without serious deterioration. Currey et al, in U.S. Pat. No. 3,403,091, issued Sept. 24, 1968, describe a concrete-type cell wall which is impervious to the cell environment and sufficiently flexible and resilient to withstand stresses within a cell without rupturing. Such a cell, in addition to being bulky and heavy, suffers from the disadvantage of attack by the cell environment over a period of time under typical operating cell conditions.

It is accordingly an object of the invention to provide an electrolytic cell top for the production of alkali metal halates which is constructed of an inner surface which is relatively inert to the conditions of liquid and gaseous components in the interior of a halate cell during typical operating conditions.

Another object of the present invention is to provide a halate cell top which is not prohibitively expensive to construct.

A further object of the present invention, is to provide a chlorate cell top which is readily fabricated.

A still further object of the present invention is to provide a halate cell top which is relatively light in weight and capable of removal for repair or inspection.

A still further object of the present invention is to provide a halate cell top which excludes any interior lining materials which could form explosive compositions with chlorates or perchlorates.

These and other objects will become apparent to those skilled in the art from the description of the invention which follows.

SUMMARY OF THE INVENTION

In the present invention, an enclosed cell top structure is provided in which the interior surface is constructed entirely of titanium. Although for reasons of weight savings and reduction in expense, the titanium constituting the inside surface of the herein disclosed halate cell top is not of sufficient thickness to be self-supporting, this invention contemplates use of a self-supporting cell top constructed entirely of titanium. In order, however, to achieve significant reductions in weight and expense, supporting structure is necessary. This disclosure will describe two embodiments of such supporting structure, the first of which can be readily adapted to the present invention from existing halate cell tops in present commercial use, as, for example, described in U.S. Pat. No. 3,732,153 to Harke et al. The second embodiment of this invention described herein represents an alternative supporting means for a titanium-lined halate cell top.

Use of titanium to form the interior surface of the halate cell top can prolong the useful life of a halate cell to a period of several years, as opposed to the shorter useful life of conventional fiberglass-reinforced plastic resin tops constructed of materials with the best known chemical resistance and fire retardancy, which have been found to display a useful life of at most several months. This can result in significant cost savings in replacement or repair of cell parts caused by deterioration and degradation, reduction in lost operational time in servicing electrolytic cell apparatus, and reduced maintainance time and expense of cell parts. Furthermore, danger of explosive combination with organic cell wall materials is eliminated, and the relative imperviousness of the metallic liner to gaseous and liquid contents of the cell prevents escape of these materials, with consequent increases in yields in the prevention in the escape of cell contents which could constitute potentially deleterious environmental and health hazards. Installation of the present invention in electrolytic apparatus requires a minimum of fabrication, and little maintenance or supervision in actual use with only minor changes necessary in controls during continuous operation. In greatly extending the useful life of halate cells, utilization of the present invention can be expected to return the initial cost of installation of the invention within a reasonably short period of time.

DETAILED DESCRIPTION OF THE DRAWINGS

Figure 1:
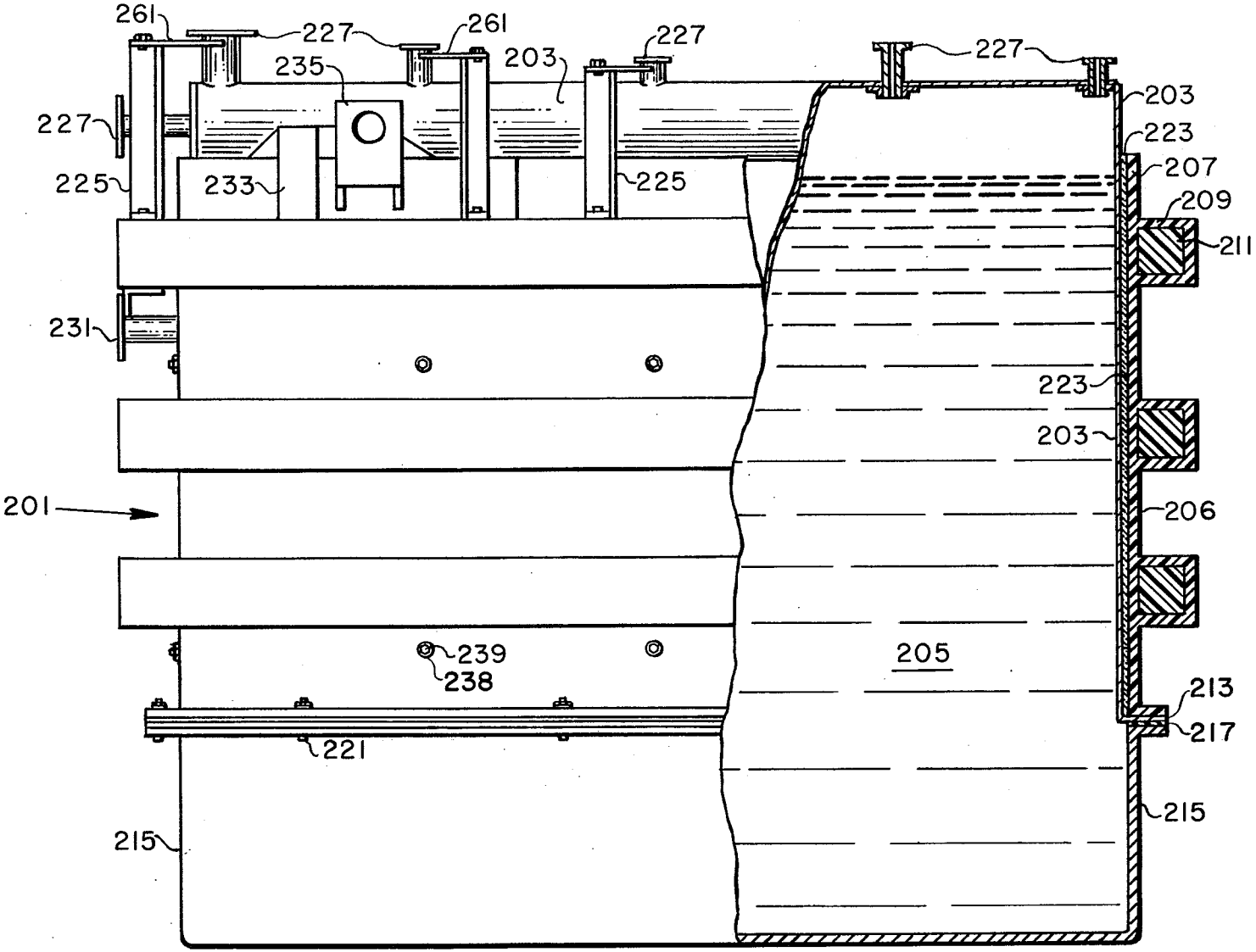
FIG. 1 shows a side view of the halate cell of the present invention, wherein a fiberglass reinforced plastic cell top as disclosed in U.S. Pat. No. 3,732,153 to Harke et al has been adapted for use with the present invention. A titanium liner has been enclosed by the middle section of the fiberglass reinforced plastic, which serves as a support means for the liner.

As shown in FIG. 1, the halate cell is shown generally by 201. Supporting structure 206 of cell 201 constitutes a portion of the apparatus described in U.S. Pat. No. 3,732,153 to Harke et al, which is hereby incorporated by reference, and designated therein by the numeral 13. The top portion of the Harke et al cell top is cut off and removed at a level near the break point, that is, just above the level of electrolyte (shown in FIG. 1 of the Harke et al patent). Supporting structure 206 can comprise a fiberglass-reinforced unsaturated polyester resin or other suitable plastic, preferably a type containing chlorendic acid and cured with styrene, and supporting structure 206 is lined with an electrolyte-resistant plastic, for example, a chlorinated polyvinyl chloride that is substantially free of plasticizers and is suitable for high temperature applications. The resin is also of sufficiently great strength to withstand hydrostatic pressures transmitted through titanium liner 203 and filler 223 from electrolyte 205. The unsaturated fiberglass-reinforced polyester walls 207 can be additionally reinforced with integral or molded-in polyester ribs 209 projecting outwardly from said walls 207, which ribs 209 are filled with a polyester, polyether or polyurethane foam material 211, preferably a rigid, fire-retardant polyurethane foam based on chlorendic acid. Alternatively, instead of molding the ribs with the walls, they may be cemented on. The foam filling adds strength and little weight, and aids in maintaining the shape of the reinforcing channels. Such ribs are illustrated as horizontal, although vertical units may also be employed, such as unit 233, to furnish additional strength and structural stability. Lifting lugs 235 permit raising the cell top from above, for example, by means of an overhead crane. The cell bottom 215 constitutes the electrolytic portion of the halate cell, wherein sodium chloride and water are electrolyzed and wherein hypochlorite is collected and converted to chlorate. In functioning as the cathode in the operation of the cell, cell bottom 215 may be constructed of steel, which is kept out of electrical contact with titanium cell top liner 203, by means of spacing gasket 217, made of a synthetic plastic or elastomeric substance. Anodes immersed within electrolyte 205 are not shown in the illustrations of the present invention.

Figure 2:
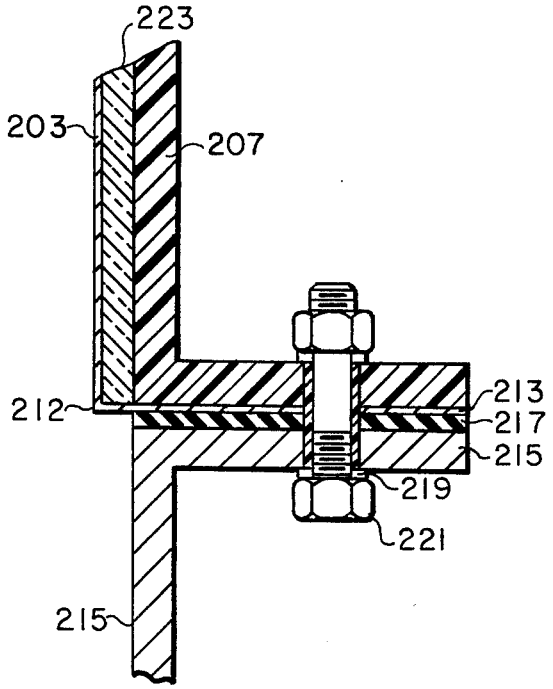
FIG. 2 is an enlargement of the region in which the cell top is joined to the bottom or electrolytic portion of the halate cell.

The sealing means between the cell top 201 and the cell bottom 215 are shown in greater detail in FIG. 2. The titanium wall 203 is bent at point 212 and the lower edge forms titanium flange 213, by leaving an open square region 402 at the edges, best seen in the top view in FIG. 4. Sealing gasket 217 prevents electrical contact between the titanium liner 203 of cell top 201 and the steel cell bottom 215. Bolts 221 apply a compressive force to form a leak-proof seal between the cell top 201 and cell bottom 215. As can be best seen in FIG. 2, an enlarged sectional view of the interface between the cell top and bottom, bolt 221 is kept out of electrical contact with steel cell bottom 215 and with titanium cell top 213 by means of sleeve 219, which is formed of an electrically insulating material, such as a laminated plastic comprising paper, glass fiber, asbestos, or boron fibers impregnated with 30% or more of thermosetting phenolic resin, an example of which is the commercially available product Micarta, a trade name of Westinghouse Corporation. Welding of the sealing surface is necessary only near the four corners 402 (see FIG. 4), at each of which a square of titanium sheet is welded to form a leak-proof smooth joint 404 (see FIG. 4). Welding is thereby avoided at point 212 in FIG. 2, minimizing the danger of development of cracks and leakage at this point, and avoiding expensive welding around the periphery of the titanium liner. Filler material 223 is a low-density rigid insulating material, such as a polyester resin formed from 0.5 mole fraction of chlorendic acid and maleic anhydride in about 0.5 mole fraction of neopentyl glycol, in about 45 parts of styrene per 100 parts of resin, as described in U.S. Pat. No. 3,763,083 to Grotheer, which patent is hereby incorporated by reference, and wherein the resin filling space 223 is designated as "Resin A". Fluids or instrument leads can be introduced into or withdrawn from cell 201 through ports or openings designated herein as "nozzles". Hydrogen withdrawal nozzles 227 are welded along the length of the top of the titanium cell liner 203. Temperature sensor inlet nozzle 231 passes through cell top support structure 207 and is welded to titanium cell liner 203. Electrolyte overflow nozzle 229 is welded to titanium cell liner 203, and this nozzle 229 holds the electrolyte level below a predetermined maximum height.

Figure 3:
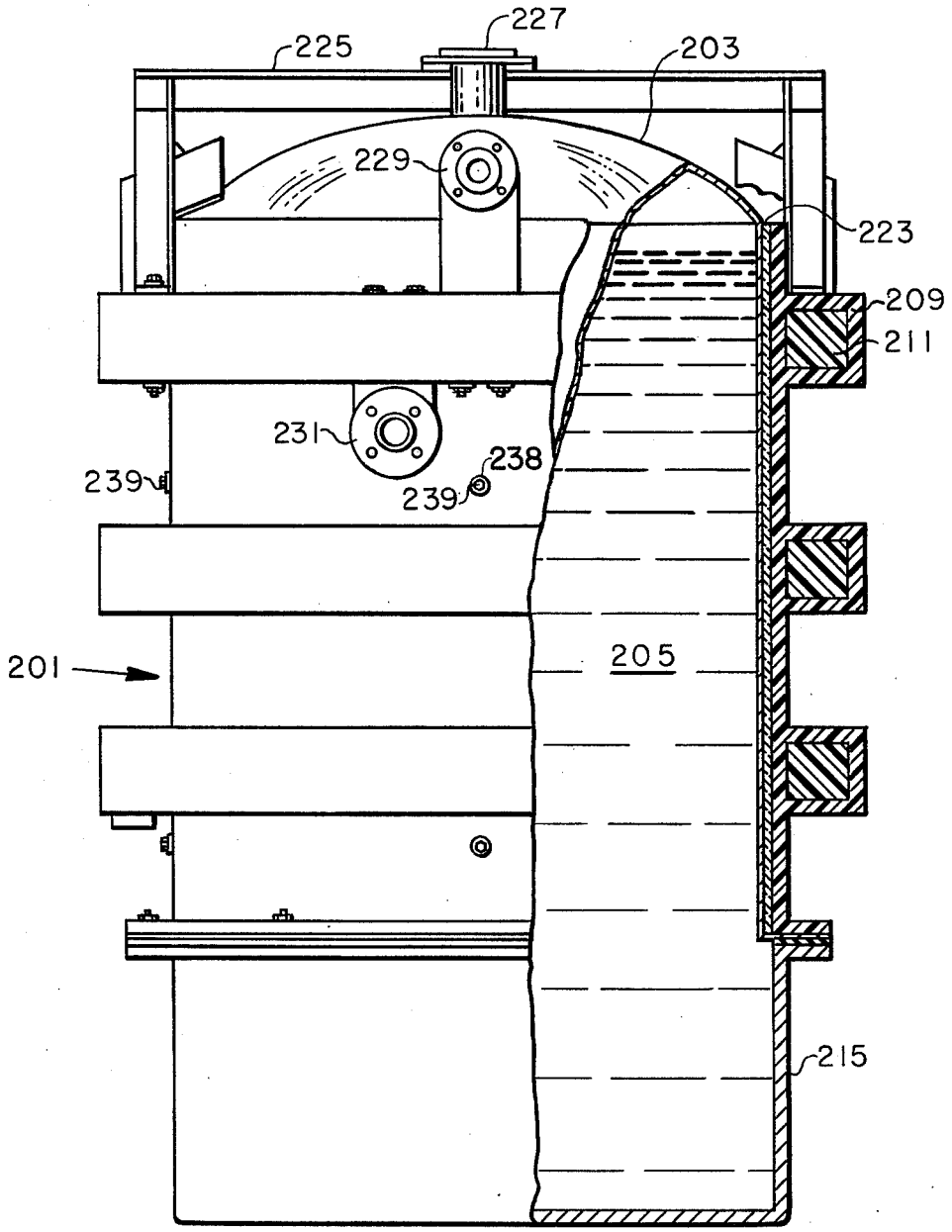
FIG. 3 is the end view of the same embodiment.

In FIG. 3, supporting frame 225 and plates 261 are attached to channels 209 and are composed of fiberglass-reinforced polyester angles, such as the commercially available product Extren, a trade name of Morrison Molded Fiberglass Company, providing support for nozzles 227 for withdrawal of hydrogen. Means for securing supporting structure 207 to liner 203 are illustrated in FIG. 1, where bolt 239 and washer 238 are shown, bolt 239 passing through supporting structure 207 and into a threaded knot welded on the outer surface of titanium liner 203 within the space occupied by plastic 223. Bolts 239 are located on each side and on each end of supporting structure 201, and secure all elements of the assembly.

Figure 4:
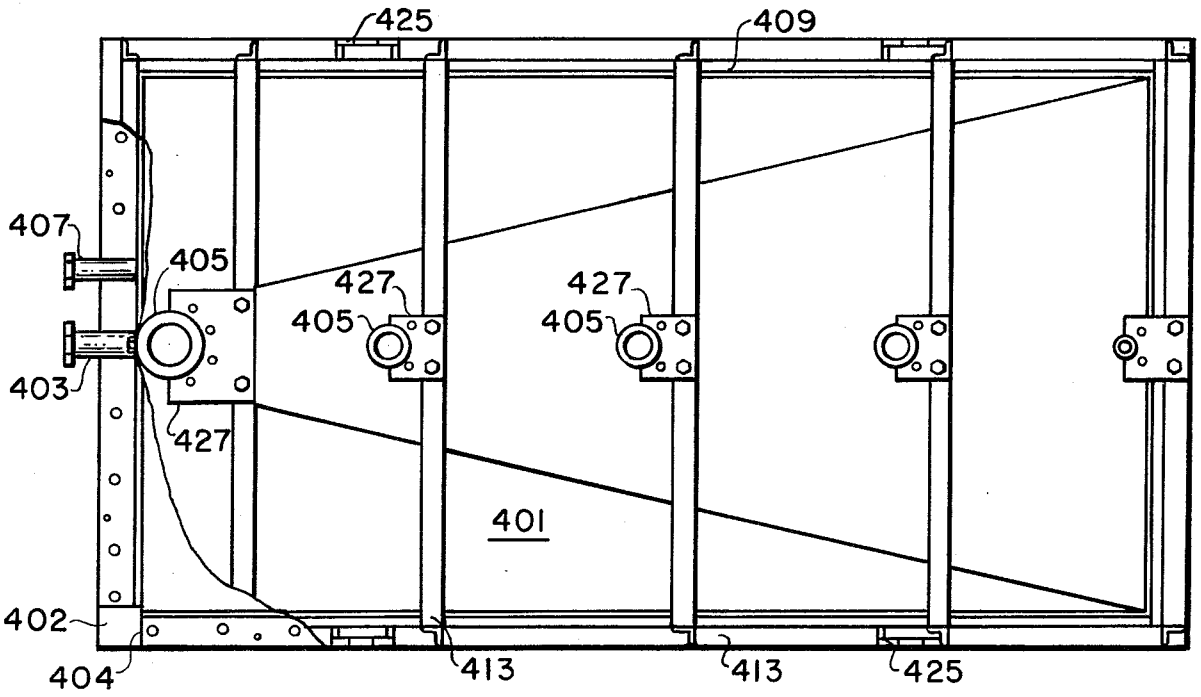
FIG. 4 is a top view of the second embodiment of the present invention, wherein a titanium liner is supported by a fiberglass basket surrounded by steel support members.

In FIG. 4, showing a top view of a second embodiment of the present invention, the titanium cell top liner 401, preferably of unitary construction is enclosed by a basket-like fiberglass grating 409, which is supported by steel basing 413. Fiberglass grating 409 provides mechanical support and electrical insulation. Nozzles 405 with attached flanges are supported by steel plates 427 which steel plates 427 are bolted or riveted to steel basing support members 413. Electrolyte overflow nozzle 403 and temperature sensor nozzle 407 are welded to cell top liner 401.

Figure 5:
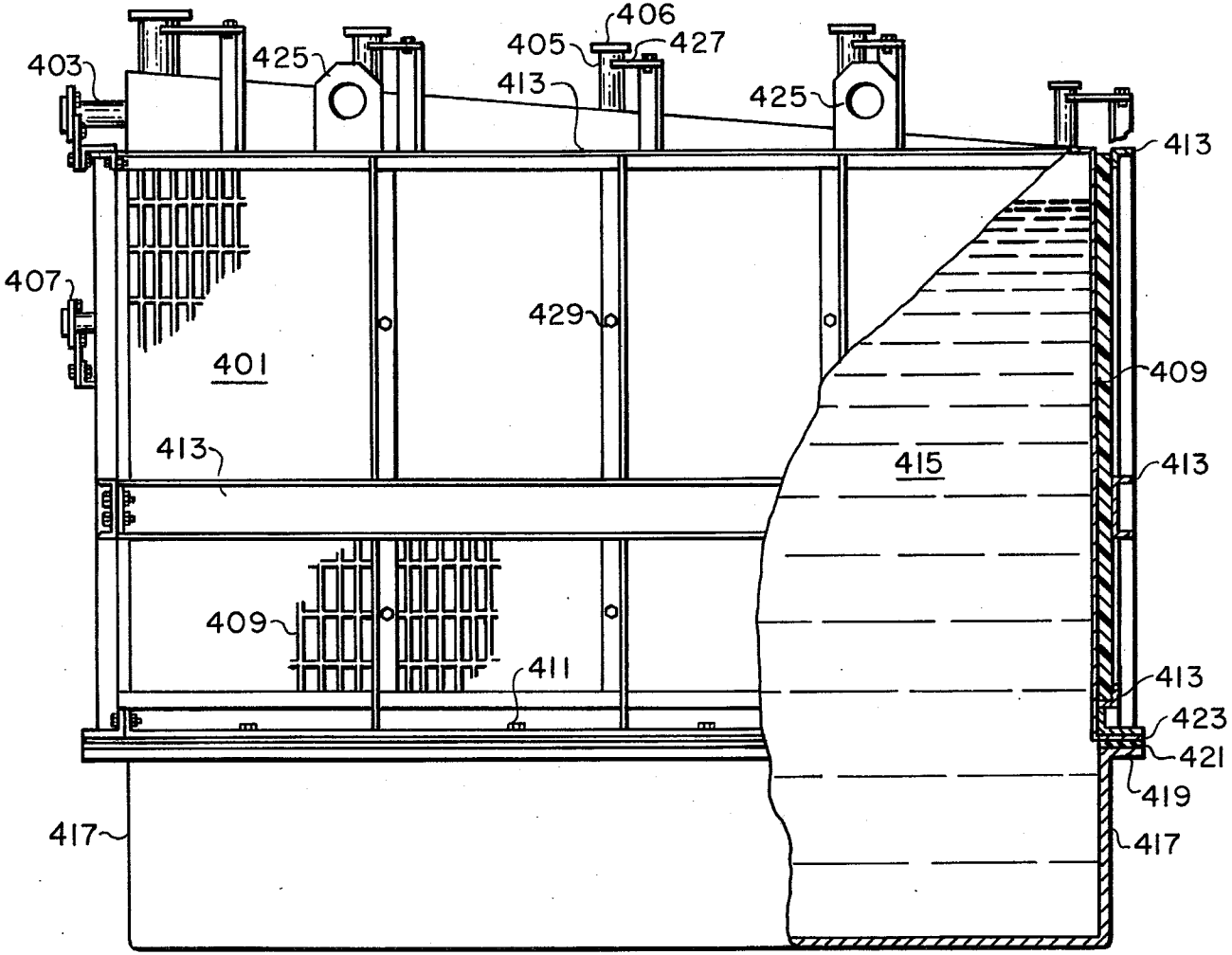
FIG. 5 is a side view of the same embodiment.

FIG. 5 shows a side view of the same embodiment in which electrolyte 415 is contained within titanium cell top liner 401 and steel cell bottom 417. Lifting lugs 425 permit raising of the cell top by means of, for example, an overhead crane (not shown). Spacing gasket 421, which can be a synthetic plastic or elastomeric substance, permits sealing of the cell top and cell bottom so as to prevent electrical contact between cell top liner 401 and cell bottom 417, and simultaneously gasket 421 prevents leakage of electrolyte 415 from the cell. An electrically insulating sleeve can be made of a laminated plastic comprising paper, glass fiber, asbestos or boron fibers impregnated with 30% or more of thermosetting phenolic resin, an example of which is the commercially available product Micarta, a trade name of Westinghouse Corporation, said sleeve enclosing bolt 411 so as to keep bolt 411 out of electrical contact with cell bottom 417 and with cell top liner 423 and supporting frame structure 413. Electrolyte overflow nozzle 403 is welded into titanium cell top 401, and temperature sensor nozzle 407 passes through fiberglass grating 409 and is welded to titanium cell top liner 401. The steel supporting structure 413 is bolted to titanium cell top liner 401 by means of bolts 429, which pass through fiberglass grating 409 and into a threaded knot which is welded to titanium cell top liner 401. Anodes present within electrolyte 415 are not shown in FIGS. 5 or 6.

Figure 6:
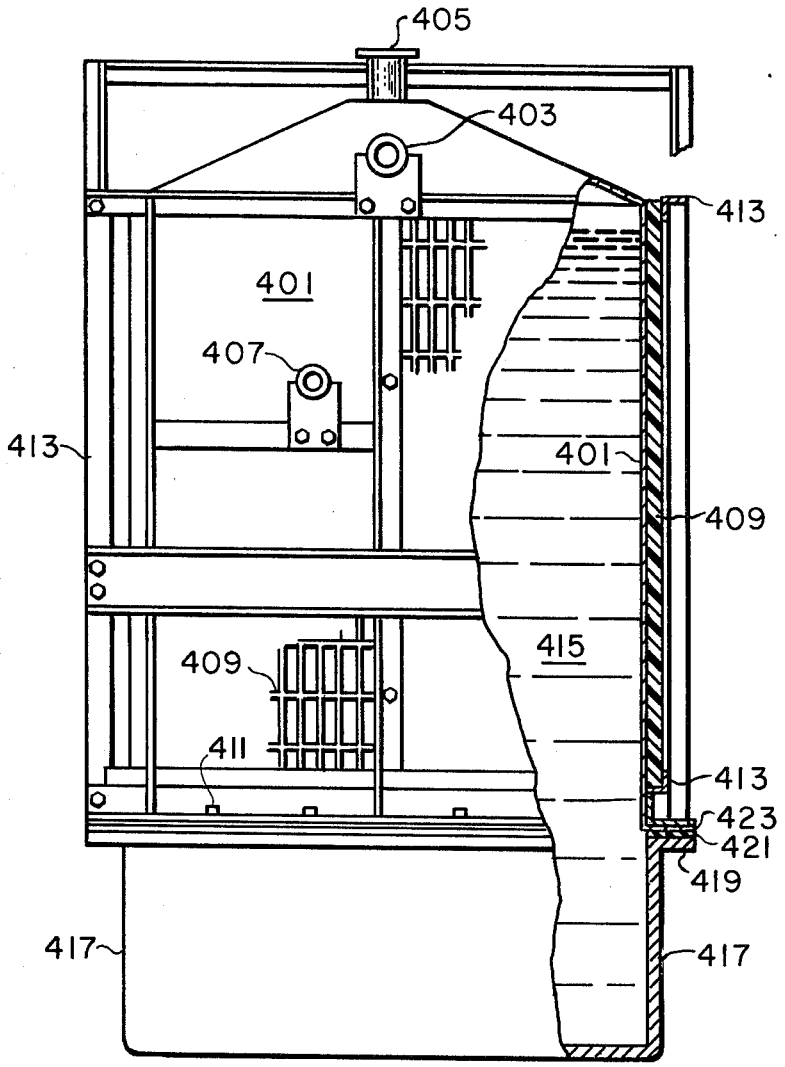
FIG. 6 is the corresponding end view.

FIG. 6 is the end view of the second embodiment of the present invention shown in FIG. 5 as the side view. FIG. 6 shows titanium cell top liner 401, grating 409, supporting structure 413, cell bottom 417, and electrolyte overflow nozzle 403, temperature sensor nozzle 407, and hydrogen withdrawal nozzles 405. Gasket 421 prevents electrolyte 415 from leaking past liner 423 in the sealing region.

It is important that the thickness of titanium cell top liner 401 in FIGS. 4, 5 and 6, and of titanium liner 203 in FIGS. 1, 2, and 3 be sufficient to withstand hydrostatic stresses and forces arising from the weight of the cell top liner and attached accessories. It has been found that the titanium liner should be at least 0.032 inch in thickness in order to withstand successfully forces arising from the present design in conventional cell sizes, this thickness being sufficient to insure an appropriate margin for safety. The titanium liner thickness should be minimized, and should be preferably be less than 0.5 inches, in order to reduce material costs.

The invention has been described with respect to various illustrations thereof but it is not to be considered as limited to these because it will be clear to one skilled in the art that equivalents and substitutes may be employed without departing from the spirit of the invention or going outside its scope. In the specification and claims, parts and proportions are expressed by weight and temperatures in degrees Centigrade unless specified otherwise.

What is claimed is:

1. In an electrolytic cell for the manufacture of alkali metal halate, wherein said cell comprises a cell top joined to a cell bottom below the level of enclosed electrolyte, the improvement comprising providing a titanium interior surface of said cell top, said titanium surface being electrically insulated from said cell bottom which functions as the cathode of said cell.

2. The cell of claim 1 wherein said titanium surface is a titanium liner of unitary construction.

3. The cell of claim 1 wherein said titanium plate and said cell bottom are flanged and held together in electrolyte-tight engagement with an elastomeric spacing gasket.

4. The cell of claim 2 wherein said titanium liner is enclosed about its periphery by a supporting framework.

5. The cell of claim 4 wherein said titanium liner is between about 0.032 inches and about 0.5 inches in thickness.

6. In an electrolytic cell for the manufacture of alkali metal halate, wherein said cell comprises a cell top joined to a cell bottom below the level of enclosed electrolyte, wherein said cell bottom functions as the cathode of said cell, the improvement which comprises providing as the cell top a titanium liner enclosed about its periphery by a support framework having ribs projecting outwardly from said support framework in a substantially horizontal direction.

7. The cell of claim 6 wherein said titanium liner and said cell bottom are flanged and held together in electrolyte-tight engagement with an elastomeric spacing gasket.

8. The cell of claim 7 wherein said alkali metal halate is sodium chlorate.

9. The cell of claim 7 wherein said titanium liner is between about 0.032 inches and about 0.5 inches in thickness.

10. The cell of claim 6 wherein said support framework comprises fiberglass-reinforced polyester resin with integral fiberglass-reinforced polyester ribs.

11. In an electrolytic cell for the manufacture of alkali metal halate, wherein said cell comprises a cell top joined to a cell bottom below the level of enclosed electrolyte, wherein said cell bottom functions as the cathode of said cell, the improvement which comprises providing as the cell top a titanium liner enclosed about its periphery by a grating held in place by supporting rigid metal members.

12. The cell of claim 11 wherein said titanium liner and said cell bottom are flanged and held together in electrolyte-tight engagement with an elastomeric spacing gasket.

13. The cell of claim 11 wherein said titanium liner is between about 0.032 inches and about 0.5 inches in thickness.

14. The cell of claim 11 wherein said grating is made of fiberglass.

15. The cell of claim 1 wherein the cell top is constructed entirely of titanium.

* * * * *